United States Patent [19]

Riedel

[11] 4,262,926

[45] Apr. 21, 1981

[54] SKI BRAKE

[75] Inventor: Tilo Riedel, Eching, Fed. Rep. of Germany

[73] Assignee: S.A. Etablissements Francois Salomon & Fils, Annecy, France

[21] Appl. No.: 70,115

[22] Filed: Aug. 27, 1979

Related U.S. Application Data

[62] Division of Ser. No. 815,364, Jul. 13, 1977, abandoned.

[30] Foreign Application Priority Data

Jul. 21, 1976 [DE] Fed. Rep. of Germany ..... 2632849

[51] Int. Cl.[3] ..... A63C 7/10

[52] U.S. Cl. ..... 280/605

[58] Field of Search ..... 280/605, 604, 12 AB; 188/5, 8

[56] References Cited

U.S. PATENT DOCUMENTS 4,059,284 11/1977 Schwarz ..... 280/605

FOREIGN PATENT DOCUMENTS 2413099 10/1975 Fed. Rep. of Germany ..... 280/605

2278363 2/1976 France ..... 280/605

*Primary Examiner*—David M. Mitchell

*Attorney, Agent, or Firm*—Karl F. Ross

[57] ABSTRACT

A ski brake has a pair of ski elements flanking the ski and each formed by a pair of wires which in the braking position with the ski element projecting down below the bottom of the ski extend at an angle to each other, and which in the rest position extend parallel to the normal displacement direction of the ski and to each other. One of the legs of each of these elements is pivoted about an axis fixed on the ski and the other is pivoted about an axis which can be moved toward and away from the immovable axis on the ski for swinging of the elements up and down between the brake and rest positions. A spring is provided either in the form of a springy joint between the lower ends of the two legs or as a separate compression spring to urge the legs into the brake position. An actuator is displaceable from a raised or advanced position into a depressed position to move the brake elements into the rest position and is similarly urged into the raised or advanced position by the spring.

10 Claims, 11 Drawing Figures

Fig.3
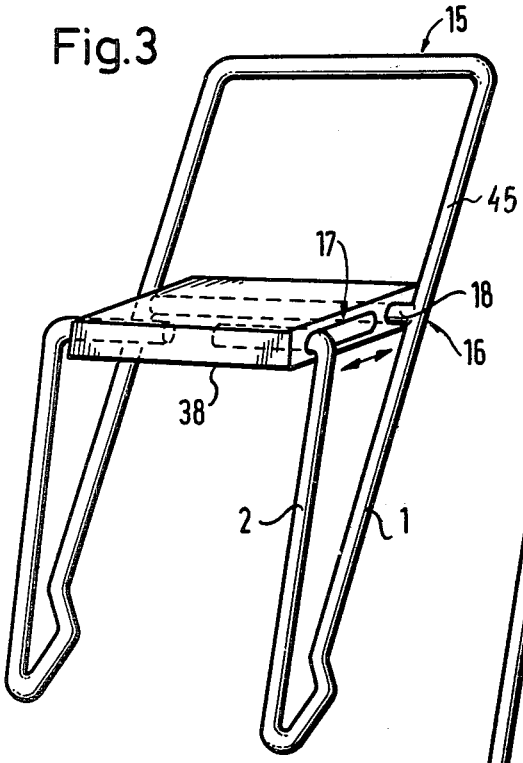
Fig.4
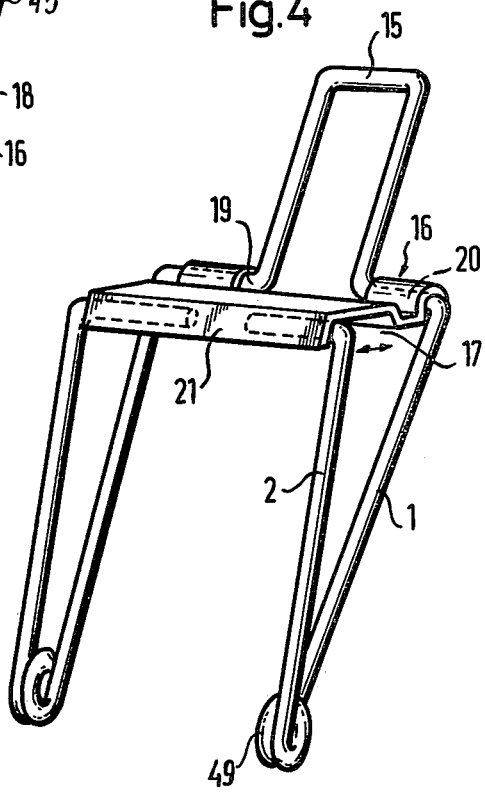
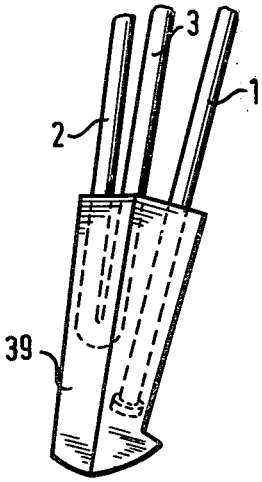
Fig.5

SKI BRAKE

CROSS-REFERENCE TO RELATED APPLICATIONS

This application is a division of application Ser. No. 815,364 filed July 13, 1977, now abandoned and itself related to my applications Ser. Nos. 666,232 (now abandoned and replaced by application 936,596, now U.S. Pat. No. 4,171,826, filed Aug. 24, 1978), 678,706 (now U.S. Pat. No. 4,123,083), 707,453 filed July 21, 1976 (now abandoned), 712,957 filed Aug. 9, 1976 (now abandoned), 712,958 (now U.S. Pat. No. 4,138,136), and 781,447 (now U.S. Pat. No. 4,139,213).

FIELD OF THE INVENTION

The present invention relates to a ski brake. More particularly this invention concerns a device for slowing or stopping a ski should it come loose from a skier's boot.

BACKGROUND OF THE INVENTION

As described in my above-mentioned copending applications a ski brake serves to slow or stop a ski which has broken away from a skier's boot. To this end such a ski brake usually comprises a braking element which during normal use of the ski assumes a rest position that is out of the way and normally parallel to the normal direction of travel of the ski along the snow. When the skier's boot pulls free from the ski, however, the brake element automatically assumes a position transverse to the ski and projecting beyond the lower surface thereof. Thus should the tie connecting the skier's boot to the ski break, a not uncommon circumstance, the ski nonetheless will be prevented from running freely down the slope where it could cause grave injury.

The principal difficulty with most of the prior-art ski brakes is that they are relatively complex. Thus they add considerably to the cost of the skier's equipment, and in addition their complexity makes them much more failure prone than is acceptable. It is essential that the ski brake function every time it is needed, and further the ski brake should not add so much to the cost of the equipment that the skier will do without it, thereby passing up a commendable safety device.

It is therefore an object of the present invention to provide an improved ski brake.

Another object is to provide such a brake which is extremely simple in construction.

A further object is the provision of a ski brake which functions automatically and surely every time it is needed, yet which can be built at relatively low cost.

SUMMARY OF THE INVENTION

These objects are attained according to the present invention in a ski brake which is used on a ski having a snow-engaging lower surface and a boot-carrying upper surface. The ski brake has a pivot on the ski defining an immovable pivot axis which is fixed relative to the ski and which extends generally parallel to the upper and lower surfaces of the ski and transverse to the normal forward direction of travel of the ski along the ground or snow. A guide is also provided on the ski which defines a movable pivot axis generally parallel to and spaced in the ski travel direction from the immovable pivot axis and displaceable in the travel direction between an unactuated position relatively far from the immovable pivot axis and an actuated position relatively close thereto. The brake element has a guided leg which in turn has one end pivoted in the guide at the movable pivot axis and a pivot leg which has one end pivoted in the pivot about the immovable pivot axis. These legs have opposite joined-together other ends and the brake element itself is displaceable between a braking position with the movable axis in the unactuated position and the legs extending at an acute angle to each other transverse to the travel direction and downwardly below the lower surface of the ski and a rest position with the legs extending generally parallel to the direction and lying above the lower ski surface. Means is provided including an actuator connected to one of the legs of the brake elements and displaceable on the ski between an advanced position and a depressed position spaced from the advanced position for displacing the braking element from the rest into the braking position on displacement of the actuator from the advanced into the depressed position. Spring means is connected to the element for urging it into the braking position, for urging the actuator into the advanced position, and for urging the movable pivot axis into the unactuated position.

In accordance with further features of this invention the ski brake has two such brake elements each of whose legs are formed of spring-steel wire. The spring means may be formed as a unitary elbow or loop at the other ends of the legs. Alternately these other ends can be pivoted together and a compression spring can be provided to urge the arrangement into the unactuated position. A resilient body may be molded over the legs at their other ends to further constitute spring means.

The guided leg according to this invention has a bent over other end which is received in the guide and which itself defines the movable pivot axis. The guide can either be an element pivotal about an axis on the ski so that the movable pivot axis therefor moves angularly in an arcuate path centered on this lever axis or the guide can be formed with or form with the ski a slot extending in the ski travel direction and having ends defining the actuated and unactuated positions of the movable axis.

According to another feature of this invention the movable pivot axis is defined by the edge of a mounting plate for the ski brake and constituting the guide. When moved from the braking to the rest position the guided leg slides over the edge of the guide so that in effect the movable pivot axis is movable relative to the guided leg, this edge therefore constituting a pivot fulcrum for the guided leg.

It is also within the scope of this invention to bend over the other end of the guided leg and receive it in a round snug recess constituting the guide and formed in the side of a toe or heel boot clamp. This boot clamp is displaceable longitudinally so that it itself constitutes the actuator. Since the boot clamp is invariably provided with a spring which is stressed or compressed when the boot is fitted to the ski, the boot clamp will inherently spring forward or backward depending on whether it is the toe or heel clamp when the boot is released so as to move the recess and displace the brake element into the braking position.

The ski brake according to further features of this invention has two such brake elements which flank the ski and move jointly from the rest to the brake position. To this end one or the other leg of each of the brake elements is formed integrally with the corresponding leg of the other element by means of a projection and a transverse bight portion constituting the actuator.

Thus in accordance with the present invention an extremely inexpensive and simple ski brake is provided. The biasing of the various forces within the wire constituting the brake element ensures that the device will always function. At the same time any lateral shocks or the like will be automatically damped by the ski brake which is prestressed when in the rest position. In fact this prestressing makes the ski brake extremely rigid in the rest position so that the likelihood of it being damaged or bent out of shape is greatly reduced.

The novel features which are considered as characteristic for the invention are set forth in particular in the appended claims. The invention itself, however, both as to its construction and its method of operation, together with additional objects and advantages thereof will be best understood from the following description of specific embodiments when read in connection with the accompanying drawings.

BRIEF DESCRIPTION OF THE DRAWING

FIGS. 3 and 4 are perspective views of third and fourth embodiments of ski brakes in accordance with this invention;

FIG. 5 shows a modification of a ski brake according to this invention;

SPECIFIC DESCRIPTION OF PREFERRED EMBODIMENTS

Figure 1:
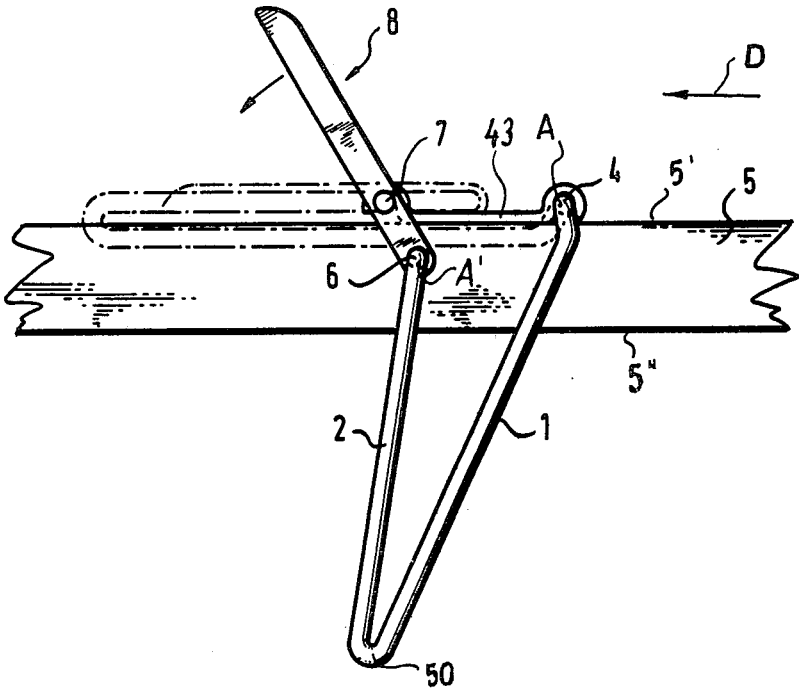
FIGS. 1 and 2 are side views of first and second embodiments of the present invention.

As shown in FIGS. 1–11 wherein like reference numerals and letters are used for functionally identical structure, all the ski brakes according to this invention have a pair of brake elements each defined by a pair of legs 1 and 2 one of which is pivoted on a ski 5 about a fixed axis A and the other of which is pivoted about a movable axis A'. The ski 5 has an upper surface 5' which normally carries a ski boot and a lower surface 5'' that normally engages the snow, this ski normally being displaceable in a direction D along the ground or snow. In all embodiments the two legs 1 and 2 are formed of spring-steel wire.

As shown in FIG. 1 the legs 1 and 2 are joined at an elbow 50 which acts as a spring to urge them apart into the braking position shown in solid lines. A mounting plate 43 forms a rear pivot at axis A for a bent-over end portion 4 of the rear leg 1, and is formed at its front end with a parallel pivot for a pin 7 on which is mounted a lever 8. The lever 8 has a long arm which acts as the actuator for the ski brake and in line with this long arm a shorter arm forming a pivot for a bent-over end 6 of the leg 2. Thus as the lever 8 is pivoted about the axis defined by the pin 7 down into the dot-dash line position of FIG. 1 the brake elements formed by the legs 1 and 2 on each side of the ski 5 are pivoted up into the dot-dash line position also, parallel to the direction D. Thus the axis A' is moved angularly about the axis defined by the pin 7 toward the axis A on depression of the lever 8 from the advanced or raised position shown in solid lines to the depressed or lowered position shown in dot-dash lines.

Figure 2:
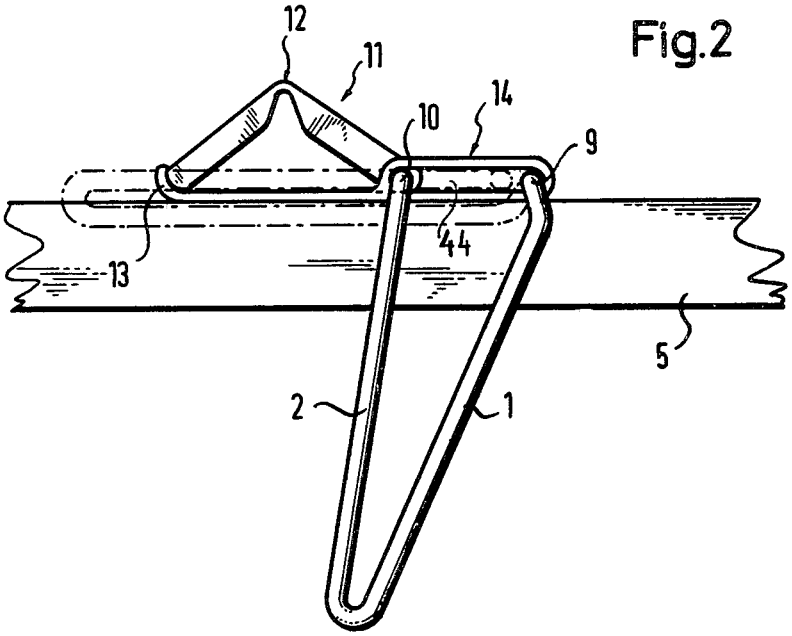

In the arrangement shown in FIG. 2 a mounting plate 14 is provided formed with a slot 44 whose rear end defines the fixed axis A for a bent-over end 9 of the rear leg 1 and whose front end defines a rest position for a bent-over end 10 of the leg 2. This bent-over end 10 defines the movable axis A' and is connected via a two-part actuating member 11 hinged at the middle at 12. The front end of this actuator 11 is braced against an abutment 13 formed on the guide 14. Thus when the actuator is flattened out from the solid-line position shown in FIG. 2 the brake element defined by the legs 1 and 2 will move up into the dot-dash line position. Normally this flattening-out of the element 11, like the pivoting down of the lever 8 of FIG. 1 is effected by placing the ski boot on top of the actuator 8 or 11.

In the arrangement of FIG. 3 the leg 1 is bent adjacent its lower end and is provided at an intermediate region 16 with a laterally projecting pin 18. In addition the leg 1 is provided with an upward extension 41 which is joined by means of an actuator bight 15 to the similar projection 45 of the opposite brake element which is spectrally identical. A mounting block 38 is formed with a slot 17 functionally identical to the slot 44 of FIG. 2. When the heel or toe of a ski boot is placed on the actuating portion or bight 15 the rear leg 1 is pivoted about the pin 18 here constituting the axis A so as to pivot up this leg 1 and to pivot up the front leg 2 which will then automatically move back in the slot 17.

The arrangement of FIG. 4 is functionally identical to that of FIG. 3 except that here a mounting plate 21 is defined with an open groove or notch 17 that defines the slot with the upper surface 5' of a ski 5. In addition this mounting plate 21 has a pair of lugs 20 which fit over the intermediate portions 16 of the legs 1 that form the axis A. The lower ends of the legs 1 and 2 are joined together at 49 at a spring loop.

FIG. 5 shows how the two legs 1 and 2, plus a third stabilizing leg 3 if desired, can be embedded in a block 39 which not only serves to increase the braking area but which increases the springiness of the assembly. The third leg 3 may be pivoted in the ski so as to increase the lateral stability of the respective braking element.

Figure 6:
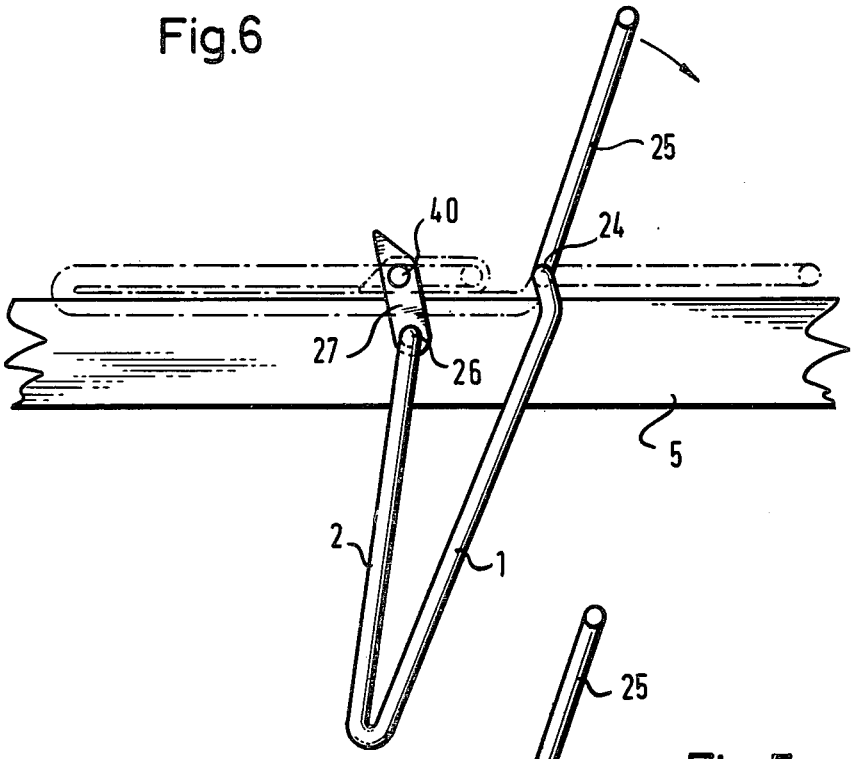
FIGS. 6, 7, and 8 are side views showing fifth, sixth, and seventh embodiments of the ski brake according to the present invention.

In FIG. 6 an actuator lever 27 is pivoted at 40 on the ski 5 and receives a bent-over end 26 of the front leg 2. The rear leg 1 has an intermediate portion 24 and extension 25 identical to the portions 16 and 41 of FIGS. 4 and 3, respectively. As the projections 25 are pressed downwardly the lever 27 will pivot up to move the legs 1 and 2 into the dot-dash rest position shown in FIG. 6.

Figure 7:
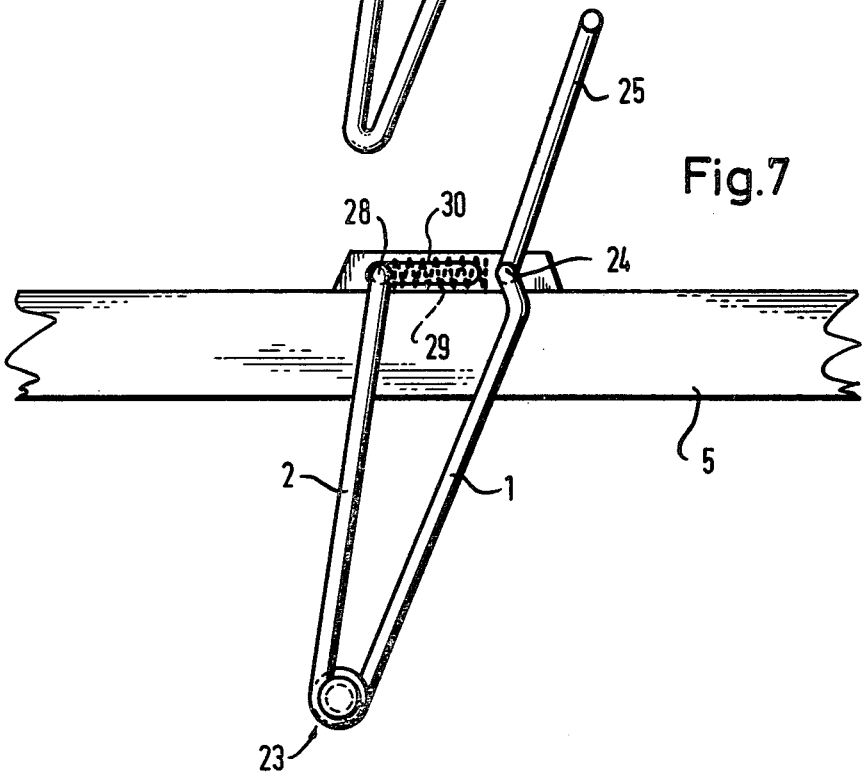

A block identical to the block 17 is employed in FIG. 7 but a spring 29 is engaged in the slot 30 to urge the bent over end 28 of the front leg 2 forwardly away from the bent-over portion 24 of the rear leg 1. In addition, the two legs 1 and 2 in this arrangement are pivoted together at 23. This pivot 23 may be provided in accordance with this invention with a torsion spring. The operation of the arrangement of FIG. 7 is identical to that of FIG. 6.

Figure 8:
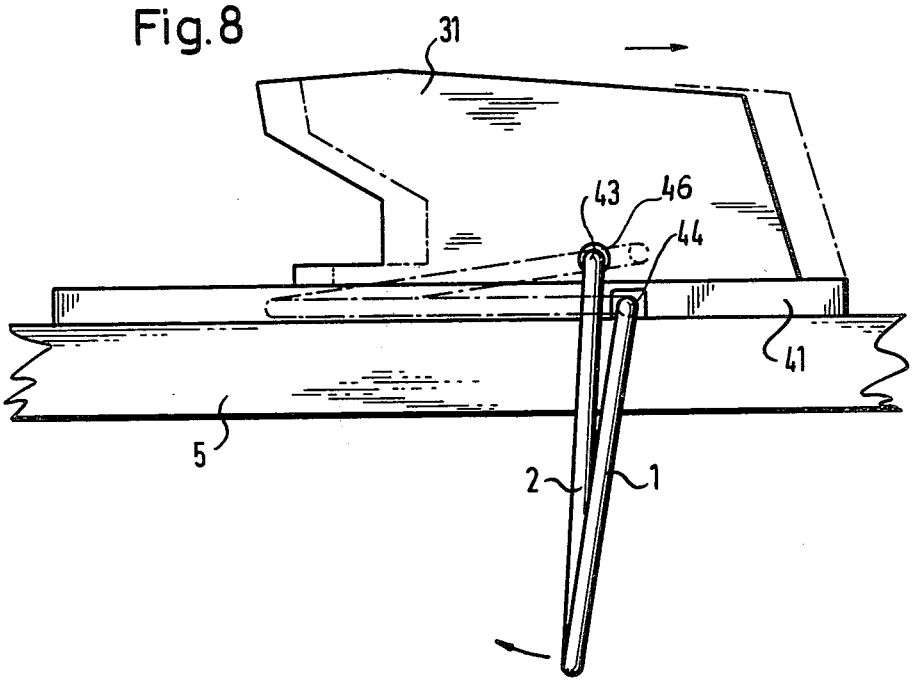
Figure 9:
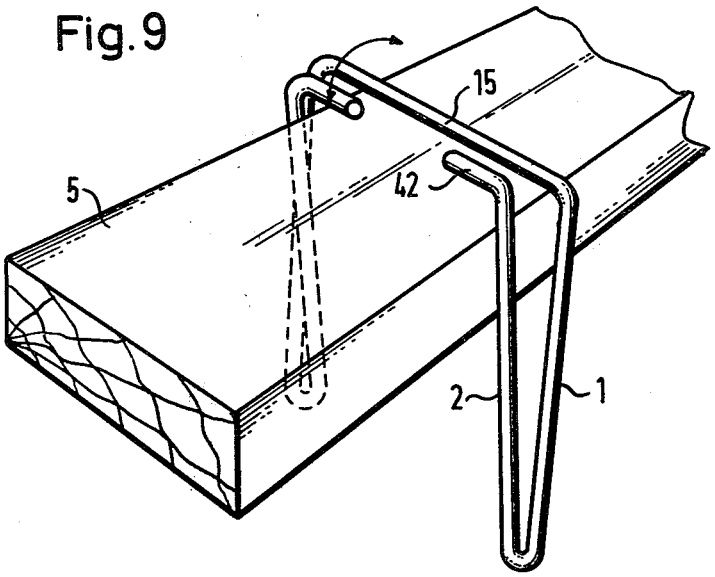
FIG. 9 is a perspective view showing the brake elements of the ski brake of FIG. 8.

In FIGS. 8 and 9 a heel clamp is provided with a guide constituted by a cylindrical recess 46 which receives the bent-over upper end of the leg 2. This heel clamp 31 is slidable on a mounting plate 41 which is fixed on the ski 5 and forms the axis A for the upper end of the leg 1 which is connected via a straight bight to the corresponding leg 1 of the other brake element. As shown also in FIG. 9 the leg 2, which lies in a plane parallel to the direction of displacement of the ski but non-parallel to the plane of the leg 1 has an upper end 42 pivoted at 46 in the heel clamp 31. Thus backward displacement of the heel clamp 41 will automatically displace the brake element formed by the legs 1 and 2 into the dot-dash position shown in FIG. 8.

Figure 10:
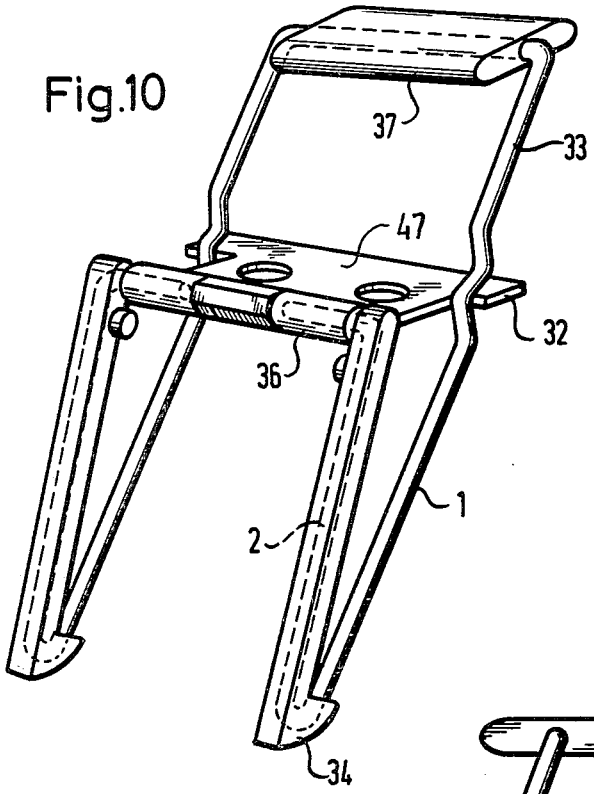
FIGS. 10 and 11 are perspective and side views of an eighth embodiment of the ski brake according to this invention.
Figure 11:
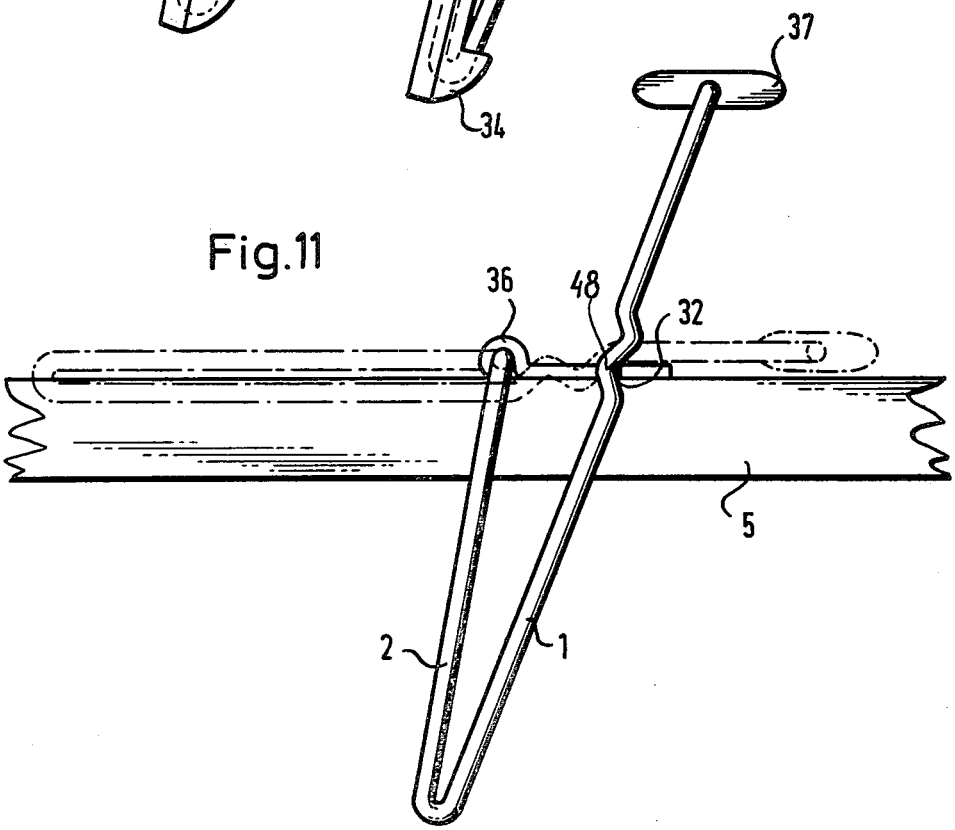

FIGS. 10 and 11 show yet another arrangement wherein the front leg 2 is completely molded into a synthetic-resin body 34 which increases the braking area and the resiliency of the elbow between the legs 1 and 2. A mounting plate 47 has lugs 36 defining the fixed pivot axis A for the front legs 2 and has at its rear end an edge 32 defining the movable pivot axis for the legs 1 which in this case are slidable along the edge 32 and which have a concavity 48 which receives the edge 32 in the rest position. A stepped-plate 37 joins together arms 33 constituting upper projections of the legs 1 so that when stepped on its automatically moves the brake elements into the dot-dash position of FIG. 11.

It is noted that any of the features of any of the embodiments can be combined with any of the features of any of the other embodiments. Thus, for instance, the spring loops 48 of FIG. 4 can be employed in any of the other arrangements, or the pivot 23 of FIG. 7 can similarly be employed with a spring such as shown at 29 in FIG. 7 in the other arrangements. The upper end of the front leg 2 can be spaced as shown in FIG. 8 by a distance equal to more than one diameter of the wire above the upper end of the leg 1 in any of the other embodiments or can be parallel thereto as shown in the other arrangements. All such combinations are considered to be within the range of the person skilled in the art.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A ski brake for use on a ski having a snow-engaging lower surface and a boot-carrying upper surface and normally adapted to travel forwardly in a predetermined travel direction, said ski brake comprising:

a pivot on said ski defining an immovable pivot axis fixed relative to said ski and extending generally parallel to said surfaces and transverse to said direction;

a guide pivotal on said ski about an immovable guide axis generally parallel to said pivot axis, said guide forming a movable pivot axis offset from said guide axis and generally parallel thereto and displaceable on pivoting of said quide at least partially in said direction between an unactuated position relatively far from said immovable pivot axis and an actuated position relatively close to said pivot immovable axis;

a brake element having a guided leg having one end pivoted in said guide at said movable pivot axis and a pivot leg having one end pivoted in said pivot about said immovable pivot axis, said legs having opposite joined-together other ends, said brake element being displaceable between a braking position with said movable axis in said unactuated position and said legs extending transverse to said direction and downwardly below said lower surface and a rest position with said legs extending generally parallel to said direction lying above said surfaces, and said movable axis in said actuated position;

means including an actuator operatively connected to one of said legs and displaceable between an advanced position relatively far from said upper surface and a depressed position relatively close to said upper surface and spaced from said advanced position for displacing said element from said braking into said rest position on displacement of said actuator from said advanced into said depressed position with concomitant pivoting of said guide about said guide axis; and spring means connected to said element for urging same into said braking position, for urging said actuator into said advanced position, and for urging said movable pivot axis into said unactuated position.

2. The ski brake defined in claim 1 wherein said guide has a pair of arms extending generally oppositely from said guide axis, one of said arms forming said movable pivot axis and the other arm extending upwardly from said ski in said braking and unactuated positions.

3. The ski brake defined in claim 2 wherein said other arm is said actuator.

4. The ski brake defined in claim 1 wherein each of said legs is a wire.

5. The ski brake defined in claim 4 wherein said spring means is a unitary elbow formed at said other ends of said legs and connecting same.

6. The ski brake defined in claim 1 wherein said pivot leg is generally straight and is formed beyond its said one end with an in-line extension constituting said actuator.

7. The ski brake defined in claim 1, further comprising a second such brake element, pivot, guide, and spring means, said second brake element being spaced axially from the first-mentioned element and having the same pivot axis, said actuator being common to both of said elements.

8. The ski brake defined in claim 7 wherein said elements and actuator are unitarily formed of a single piece of wire also forming said actuator.

9. The ski brake defined in claim 1 wherein said pivot leg is formed at its said one end with a bent-over portion in line with said immovable pivot axis and is formed unitarily to the other axial side of said bent-over portion from said pivot legs with an extension constituting said actuator and generally coplanar with said bent-over portion and said pivot leg.

10. The ski brake defined in claim 1 wherein said legs lie in respective planes both generally parallel to said direction and transverse to said axes, said legs further extending at an acute angle to each other at least in said braking position.

* * * * *